United States Patent [19]

Dorfman

[11] Patent Number: 5,038,952

[45] Date of Patent: Aug. 13, 1991

[54] CLOSURE ASSEMBLY FOR PRESSURIZED PLASTIC BEVERAGE CONTAINER

[75] Inventor: Jan L. Dorfman, Littleton, Colo.

[73] Assignee: Coors Brewing Company, Golden, Colo.

[21] Appl. No.: 450,924

[22] Filed: Dec. 14, 1989

[51] Int. Cl.[5] ..... B65D 41/10

[52] U.S. Cl. ..... 215/324; 215/1 C; 215/31; 220/310

[58] Field of Search ..... 215/1 C, 31, 247, 249, 215/324, 327; 220/309, 310

[56] References Cited

U.S. PATENT DOCUMENTS

| | | | |
|---|---|---|---|
| 521,788 | 6/1894 | Flanigan . | |
| 920,791 | 5/1909 | Tonini . | |
| 1,105,276 | 7/1914 | Jasper . | |
| 2,052,728 | 9/1936 | Stewart . | |
| 2,445,647 | 7/1948 | Thomas . | |
| 2,576,416 | 11/1951 | Randlett . | |
| 3,071,274 | 1/1963 | Ravn | 215/249 |
| 3,410,456 | 11/1968 | Johnson, Jr. et al. . | |
| 3,587,897 | 6/1971 | Rohde | 215/249 |
| 3,592,351 | 7/1971 | Johnson, Jr. et al. . | |
| 4,000,829 | 1/1977 | Johnson, Jr. et al. . | |
| 4,084,525 | 4/1978 | Booth . | |
| 4,202,456 | 5/1980 | Silber . | |
| 4,230,631 | 7/1981 | Lohrman . | |
| 4,244,478 | 1/1981 | Handman | 215/249 |
| 4,273,265 | 6/1981 | Anderson . | |
| 4,328,905 | 5/1982 | Hardt . | |
| 4,445,310 | 5/1984 | Scheidegger . | |
| 4,592,092 | 5/1986 | McPhee | 215/31 X |
| 4,637,519 | 1/1987 | Dutt et al. . | |
| 4,767,016 | 8/1988 | Cook, Jr. et al. . | |
| 4,773,553 | 9/1988 | Van Brocklia . | |

FOREIGN PATENT DOCUMENTS

| | | |
|---|---|---|
| 382089 | 9/1907 | France . |
| 410021 | 12/1909 | France . |
| 2598137 | 11/1987 | France . |
| 547337 | 8/1942 | United Kingdom . |
| 2072131 | 9/1981 | United Kingdom . |

*Primary Examiner*—Stephen Marcus
*Assistant Examiner*—Nova Stucker
*Attorney, Agent, or Firm*—Klaas & Law

[57] ABSTRACT

A closure assembly for a pressurized, plastic beverage container having an upper end opening comprising: an annular container neck defining the container upper end opening comprising a radially extending top surface, an axially extending surface, and a lower, generally radially extending surface; a gasket positioned on top of the annular container neck; and a container cap comprising a flat central body positioned in covering relationship with the container opening and in abutting engagement with the gasket; and an annular flange includinngn an axially extending portion positioned in parallel, adjacent, noncompressive relationship with the axially extending surface of the container neck, and a generally radially inwardly extending portion positioned in abutting, compressive contact with the lower, generally radially extending surface of the container neck whereby upwardly directed axial force on the container cap produced by pressurization of the container is resisted by downwardly directed axial force applied by the lower, generally radially extending surface of the container neck to the generally radially inwardly extending portion of the flange of the cap.

13 Claims, 3 Drawing Sheets

CLOSURE ASSEMBLY FOR PRESSURIZED PLASTIC BEVERAGE CONTAINER

BACKGROUND OF THE INVENTION

The present invention relates generally to pressurized, plastic beverage containers and, more particularly, to a closure assembly therefor.

Recently, a pressurized beverage dispensing container known in the industry as a "party ball" has been commercialized in the United States. This beverage dispensing container comprises a generally spherically-shaped container constructed from PET plastic which has a fluid capacity of approximately 5.16 gallons. The container has a single opening at an upper end portion thereof which is sealingly covered with a cap. The cap has a gasket associated therewith which is adapted to be resealingly penetrated at two different regions during the insertion of a pressurization conduit and a beverage discharge conduit.

A prior art closure assembly 11 for such a pressurized, plastic beverage container 13 is illustrated in FIG. 1. The beverage container 13 comprises an upper cylindrical end opening 15 circumscribed by an annular neck 17. The annular neck comprises a top radially extending surface 19 which typically has an outer diameter of approximately 2.23 inches and an inner diameter of 1.960 inches. The annular neck 17 further comprises an axially extending outer surface 21 which is integrally connected to a inwardly and downwardly sloping surface 23 which slopes approximately 30° from a vertical plane and which has a length of approximately 0.055 inch. A radially extending lower surface 25, typically having a length of approximately 0.034 inch, is integrally connected to sloping surface 23 by a shoulder surface which may have a radius of about 0.010 inch. An outwardly and downwardly extending surface 27 is connected to surface 25 through a 0.015-inch-radius surface 27. Surface 27 has a approximately 10° with respect to a vertical plane. Surface 27 is connected to an axially extending surface 29. Axially extending surface 29 terminates at a flange portion 31 which has an outer diameter of approximately 2.625 inches.

A cap 35 which is adapted to be crimpingly attached to neck 17 to seal the opening 15 comprises a flat, radially extending portion 37 and an annular flange portion 39. Cap 35 has a gasket 33 positioned on the interior side thereof which sealingly engages the top surface 19 of the neck 17. The cap flange portion 39 may have a total surface length, measured perpendicular to its direction of annular extension, of approximately 0.373 inch. Flange portion 39 comprises an axially extending portion 41, a radially inwardly and downwardly extending portion 43, and an outwardly concave, arcuate portion 45. During installation of the cap 35, a crimper tool (not shown) urges portion 43 into abutting contact with inwardly and downwardly sloping surface 23 of the annular neck.

The axial force which tends to remove cap 35 after container 13 is pressurized is resisted through the coaction of neck surface 23 and flange diagonal portion 43. Due to the fact that neck 17 is constructed from PET plastic, there is a tendency for neck 17 to flex or creep inwardly 37 due to the continuous force applied thereto by cap flange portion 43. This condition becomes especially pronounced at elevated temperatures. Such inward deflection of neck 17 may cause loss of the seal between cap gasket assembly 35, 33 and neck 17.

SUMMARY OF THE INVENTION

The present invention is directed to a closure assembly, and components thereof, which substantially eliminates certain seal loss problems which may be encountered with the above-described prior art closure assembly.

The present invention may comprise a closure assembly for a pressurized, plastic beverage container having an upper end opening comprising: (a) an annular container neck defining said container upper end opening comprising a radially extending top surface, an axially extending surface, and a lower, generally radially extending surface; (b) a gasket positioned on top of said annular container neck; and (c) a container cap comprising a flat central body positioned in covering relationship with said container opening and in abutting engagement with said gasket and an annular flange including an axially extending portion positioned in parallel, adjacent, noncompressive relationship with said axially extending surface of said container neck, and a generally radially inwardly extending portion positioned in abutting, compressive contact with said lower, generally radially extending surface of said container neck whereby upwardly directed axial force on said container cap produced by pressurization of said container is resisted by downwardly directed axial force applied by said lower, generally radially extending surface of said container neck to said generally radially inwardly extending portion of said flange of said cap.

The present invention may also comprise a closure assembly for a pressurized beverage dispensing device of the type including a plastic container having an opening at a top portion thereof defined by a container neck, and including a container cap having an annular flange portion engaged with the container neck and a flat, radially extending portion covering the container opening and provided with bores therethrough for sealingly accepting conduit therein for enabling pressurization of the container and discharge of beverage therefrom, and including a gasket mounted between the container cap and an upper surface of the container neck, characterized in that: said container neck comprises: (a) an inner axially extending surface defining an opening of approximately 1.960 inches in diameter; (b) an uppermost radially extending surface integrally connected with said inner axially extending surface by a first arcuate surface; (c) an upper, outer, axially extending surface integrally connected with said uppermost radially extending surface by a second arcuate surface and radially spaced from said inner axially extending surface by approximately 0.135 inch and having an axial length of approximately 0.093 inch; (d) a radially inwardly and axially downwardly extending surface inclined approximately 80° with respect to said upper, outer, axially extending surface and integrally connected with said upper, outer, axially extending surface by a third arcuate surface; (e) an axially downwardly and radially outwardly extending surface integrally connected with said radially inwardly and axially downwardly extending surface by a fourth arcuate surface and inclined approximately 94° relative to said downwardly and inwardly extending surface; and (f) a lower axially extending surface integrally connected with said axially downwardly and radially outwardly extending surface and radially inwardly spaced approximately 0.056 inch from said upper, outer, axially extending surface.

The present invention may also comprise a container cap for a pressurized, plastic beverage container having an upper end opening defined by an annular container neck which includes a radially extending top surface, an axially extending surface, and a lower, generally radially extending surface, comprising: a flat central body positioned in covering relationship with said container opening and in abutting engagement with said gasket; and an annular flange including an axially extending portion positioned in parallel, adjacent, noncompressive relationship with said axially extending surface of said container neck, and a generally radially inwardly extending portion positioned in abutting, compressive contact with said lower, generally radially extending surface of said container neck whereby upwardly directed axial force on said container cap produced by pressurization of said container is resisted by downwardly directed axial force applied by said lower, generally radially extending surface of said container neck to said generally radially inwardly extending portion of said flange of said cap.

The present invention may also comprise a container neck for a pressurized beverage dispensing device of the type including a plastic container having an opening at a top portion thereof defined by said container neck, and including a container cap having an annular flange portion engaged with the container neck and a flat, radially extending portion covering the container opening and provided with bores therethrough for sealingly accepting conduit therein for enabling pressurization of the container and discharge of beverage therefrom, and including a gasket mounted between the container cap and an upper surface of the container neck, said container neck comprising: (a) an inner axially extending surface defining an opening of approximately 1.960 inches in diameter; (b) an uppermost radially extending surface integrally connected with said inner axially extending surface by a first arcuate surface; (c) an upper, outer, axially extending surface integrally connected with said uppermost radially extending surface by a second arcuate surface and radially spaced from said inner axially extending surface by approximately 0.135 inch and having an axial length of approximately 0.093 inch; (d) a radially inwardly and axially downwardly extending surface inclined approximately 80° with respect to said upper, outer, axially extending surface and integrally connected with said upper, outer, axially extending surface by a third arcuate surface; (e) an axially downwardly and radially outwardly extending surface integrally connected with said radially inwardly and axially downwardly extending surface by a fourth arcuate surface and inclined approximately 94° relative to said downwardly and inwardly extending surface; and (f) a lower axially extending surface integrally connected with said axially downwardly and radially outwardly extending surface and radially inwardly spaced approximately 0.056 inch from said upper, outer, axially extending surface.

BRIEF DESCRIPTION OF THE DRAWINGS

An illustrative and presently preferred embodiment of the invention is shown in the accompanying drawings in which.

DETAILED DESCRIPTION OF THE INVENTION

The Invention In General

Figure 2:
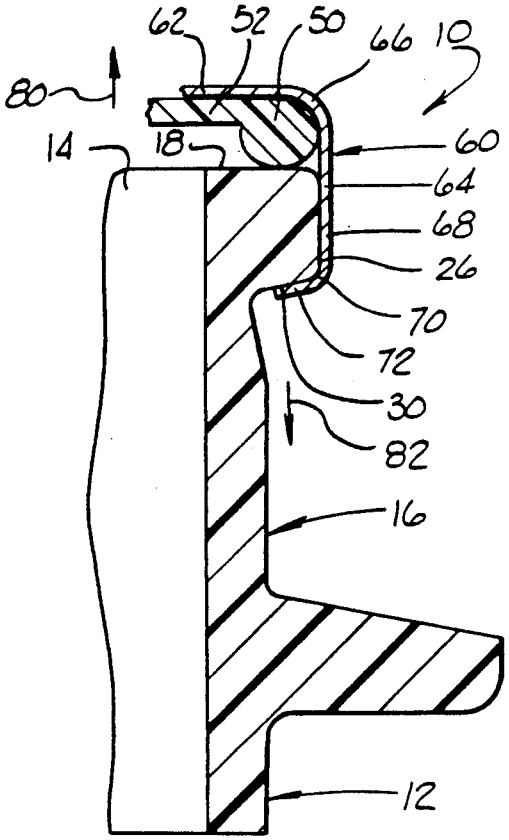
FIG. 2 is a detail cross sectional elevation view of a closure assembly for a pressurized, plastic beverage container.
Figure 6:
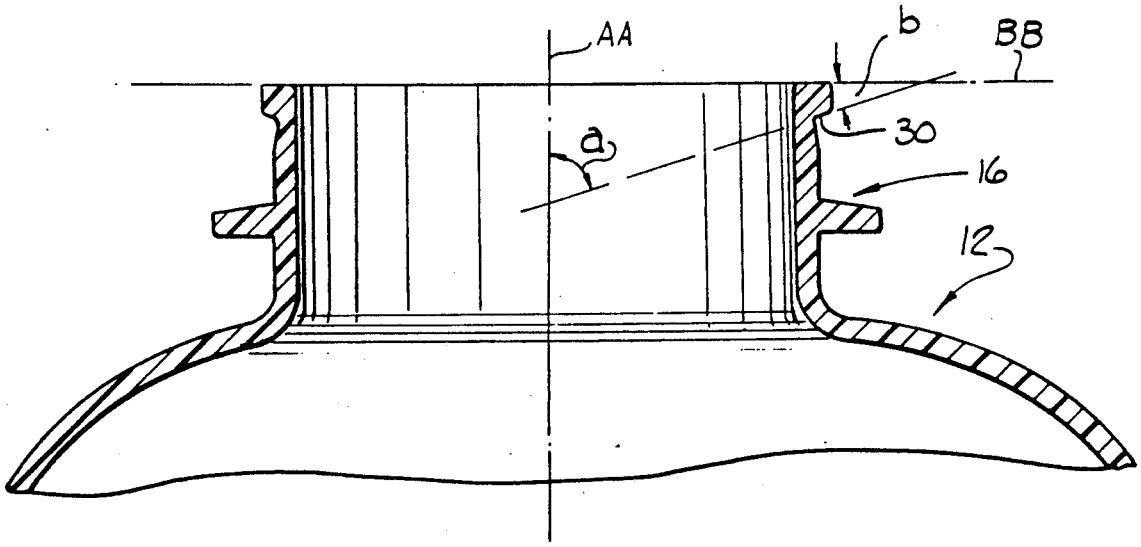
FIG. 6 is a cross sectional elevation view of an upper portion of a plastic beverage container.

A closure assembly 10 for a pressurized, plastic beverage container 12 having an upper end opening 14 is illustrated in FIG. 2. The closure assembly 10 comprises an annular container neck 16 defining the container upper end opening 14. The container neck comprises a radially extending top surface 18, an axially extending surface 26, and a lower, generally radially extending surface 30. By the phrase "generally radially extending surface" applicant means any surface which intersects the container neck central longitudinal axis AA, FIG. 6, at an angle "a" of between 70° and 110° or, conversely, which intersects radial plane BB at an angle "b" of between +20° and −20°. In a preferred embodiment of the invention, angle "a" comprises 80° and angle "b" comprises 10°.

The top assembly also comprises a gasket 50 which is secured to an interior surface of container cap 60 and which is adapted to sealingly engage annular neck radially extending top surface 18.

The closure assembly 10 further comprises a container cap 60 which includes a flat central body portion 62 positioned in covering relationship with the container opening 14 and in abutting engagement with an upper surface of gasket 50. The container cap has an annular flange 64 which includes an axially extending portion 68 positioned in parallel, adjacent, noncompressive relationship with the axially extending surface 26 of the container neck. The flange also includes a generally radially inwardly extending portion 72 positioned in abutting, compressive contact with the lower generally radially extending surface 30 of the container neck. Upwardly directed axial force 80 on the container cap 60 which is produced by pressurization of the container 12 is resisted by downwardly directed axial force 82 applied by the lower generally radially extending surface 30 of the container neck to the generally radially inwardly extending portion 72 of the flange 64 of cap 60. Due to the fact that neck surface 30 and cap flange portion 72 extend generally radially, there is no significant radial force components produced by the pressurization of the container and which would cause neck 16 to flex inwardly.

The generally radially inwardly extending portion 72 of the cap preferably comprises a length less than the length of the lower generally radially extending surface 30 of the container neck.

Having thus described the closure assembly 10 in general, certain features thereof will now be described in further detail.

Container Neck

Figure 5:
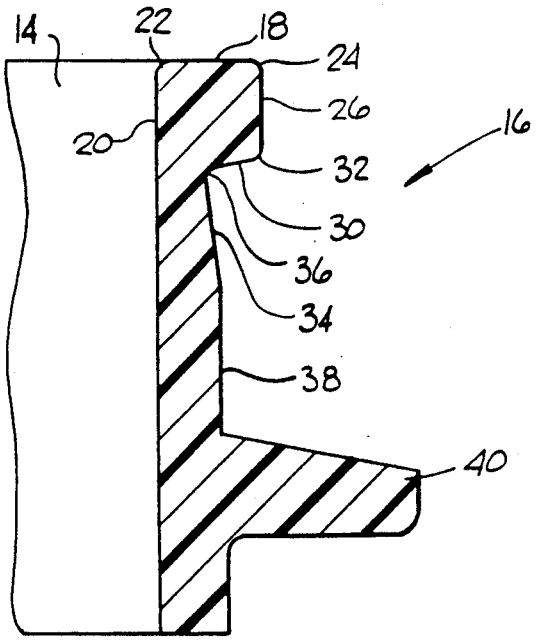
FIG. 5 is a detail cross sectional elevation view of a plastic beverage container neck.

As best shown by FIG. 5, annular container neck 16 comprises an inner axially extending surface 20 having an inside diameter of approximately 1.960 inches which defines opening 14. Surface 20 is connected to radially extending surface 18 by a small radius, e.g. 0.015 inch, shoulder portion 22. Radially extending surface 18 may be connected to axially extending surface 26 by a second shoulder portion 24 which may have a radius of curvature of 0.015 inch. Axially extending surface 26 may have an axial length of approximately 0.093 inch and may be spaced from axially extending surface 20 by a radial distance of approximately 0.135 inch. Lower radially extending surface 30 may be radially inwardly and axially downwardly inclined at an angle "b" of approximately 10° from a radial plane BB, i.e. inclined inwardly approximately 80° from axial surface 86, FIG. 6. Surface 30 may be connected to surface 26 by a third shoulder portion 32 which may have a radius of curvature of, e.g., 0.020 inch. Surface 30 is connected to an axially downwardly and radially outwardly extending surface 34 by a small radius, arcuate surface 36 which may have a radius of curvature of, e.g., 0.020 inch. Surface 34 may be inclined, e.g., 5.71° relative to the container central longitudinal axis AA (i.e. surface 34 is inclined 94.29° with respect to surface 32 and may have a length of approximately 0.159 inch. Surface 34 is integrally connected to an axially extending surface 38 which may have a length of, e.g., 0.797 inch and which may be positioned approximately 0.056 inch inwardly from axially extending surface 26. Surface 38 may terminate in an annular flange 40.

Gasket

As illustrated in FIG. 2, gasket 50 may be constructed from neoprene rubber and may comprise a flat, central, radially extending wall portion 52 having a thickness of approximately 0.050 inch and a bulbous annular end portion 54 having a radial dimension of approximately 0.075 inch and an axial dimension of approximately 0.090 inch in an unstressed state and having an axial dimension of approximately 0.065 inch when sealingly engaged between annular neck 16 and cap 60. Gasket 50 further comprises upwardly extending, mushroom-shaped portions 56, 58 which are received through circular holes (not shown) in container cap 60. Mushroom-shaped portions 56, 58 are adapted to have conduit penetratingly inserted therethrough for enabling injection of pressurized gas into container 12 and for enabling discharge of beverage therefrom. The construction of a gasket such as gasket 50 is known in the prior art, see, e.g., U.S. Pat. Nos. 3,410,456; 3,592,351; and 4,000,829 which are hereby specifically incorporated by reference for all that they disclose.

Container Cap

Container cap 60 may be constructed from metal such as cold-rolled steel having a uniform wall thickness of approximately 0.016 inch. The container cap 60, which is here described in its crimped state of FIG. 2, comprises a flat central body portion 62 which is integrally connected to an annular flange or skirt portion 64 by an arcuate shoulder portion 66 which may have an inside radius of curvature of approximately 0.063 inch. Flange portion 64 may comprise an axially extending portion 68 which is positioned in noncompressive engagement or slightly spaced relationship with axially extending surface 26 of the container neck. Axially extending portion 68 is connected to a radially inwardly extending flange or lip portion 72 by an arcuate shoulder portion 70 which may have a radius of curvature of, e.g., 0.020 inch at its inner surface. The outermost diameter of annular flange 64 may be 2.282 inches. The axial dimension from the top surface of cap flat central body portion 62 to the lowermost surface of radially inwardly extending flange portion 72 may be 0.232 inch. The radial distance between the terminal end of radially inwardly extending flange portion 72 and the radially outermost portion of flange axially extending portion 68 may be 0.07 inch.

Figure 3:
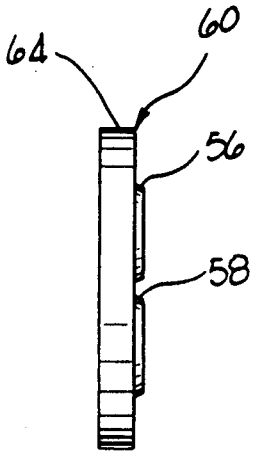
FIG. 3 is a side elevation view of a plastic beverage container cap showing a flange portion thereof in an uncrimped state.
Figure 4:
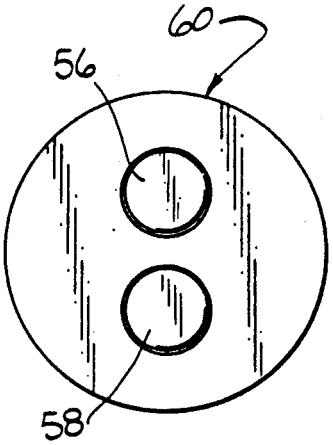
FIG. 4 is a top view of the plastic beverage container cap of FIG. 3.

FIG. 3 is a side elevation view of container cap 60 in an uncrimped state prior to attachment thereof to bottle neck 16. Annular flange or skirt portion 64 in an uncrimped state may comprise an axial length of 0.270 inch.

Assembly

In order to mount container cap 60 on neck 16, a conventional crimping tool (not shown), such as that sold as model no. TBS02100 which is commercially available from Johnson Enterprises, Inc., 216–220 North 4th Street, Rockford, Ill. 61107, telephone 1-800-435-6950, may be employed which engages an upper surface of container cap 60 which may be positioned on bottle surface 18. A radially movable portion of the crimping tool engages a distal end portion of uncrimped annular flange 64, urging it radially inwardly around neck shoulder surface 70 and into abutting contact with generally radially extending surface 30 of container neck 16, so as to drawingly urge cap 60 downwardly, thereby comprising gasket 50 against neck surface 18. When the crimping tool is released, compressed gasket 60 applies a relatively small amount of upward axial force, direction 80, to cap 60 at portion 62 thereof which is resisted through the abutting engagement between surface 30 of the neck portion 16 and generally radially inwardly extending flange portion 72 of cap 60. As the container 12 is pressurized, further upwardly directed axial force, direction 80, is applied to cap 60 which is resisted by the coaction of neck surface 30 and cap portion 72. The angle of inclination of surface 30 and portion 72 is such that the force applied against surface 30 by cap 72 has no significant radially inwardly directed force component, thus substantially eliminating any tendency of neck 16 to flex inwardly in response to pressurization of container 12.

A further advantage of cap 60 over cap 35 of the prior art is that the overall length of annular flange 64 of cap 60 is approximately 0.103 inch shorter than flange 39 of cap 35, thus reducing material cost.

Alternative Container Cap Embodiment

Figure 1:
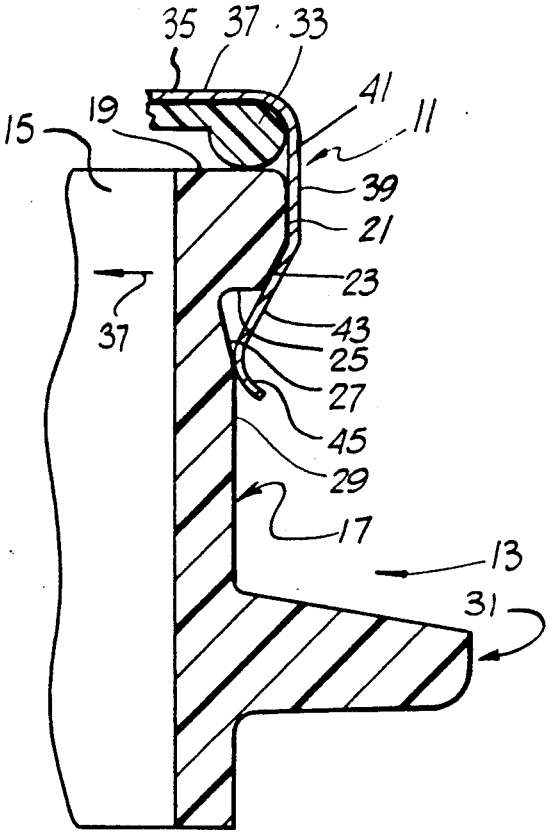
FIG. 1 (PRIOR ART)
FIG. 1 is a detail cross sectional elevation view of a prior art closure assembly for a pressurized, plastic beverage container.
Figure 7:
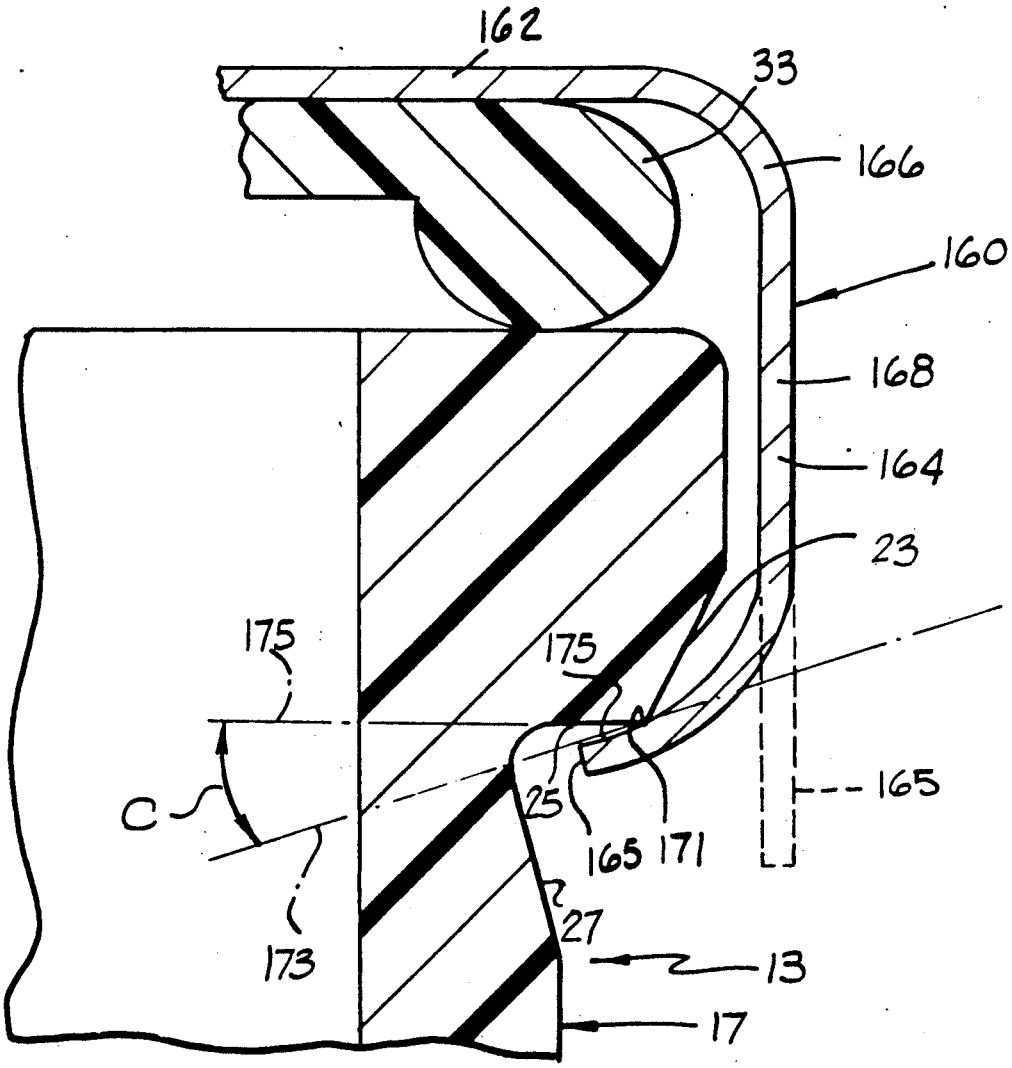
FIG. 7 is a detail cross sectional elevation view of a closure assembly for a pressurized, plastic beverage container.

An alternative container cap embodiment 160 is shown in FIG. 7 which is adapted to be used with a prior art container neck 17 and gasket 33 assembly which may be identical to those described above with reference to FIG. 1.

The container cap 160 may be constructed from cold-rolled steel having a uniform wall thickness of approximately 0.016 inch. Cap 160 has a flat central body portion 162 which is integrally connected to an annular flange or skirt portion 164 by an arcuate shoulder portion 166 which may have an inside radius of curvature of approximately 0.063 inch. The orientation of flange 164 in an uncrimped state is illustrated in phantom lines in FIG. 7. In an uncrimped state the axial distance between the upper surface of flat central body portion 162 and the terminal end 165 of flange portion 164 may be 0.270 inches. The outermost diameter of annular flange 164 may be 2.282 inches.

In a crimped state, as illustrated in solid lines in FIG. 7, annular flange portion 164 comprises an axially extending portion 168 and an inwardly concave lower lip portion 170. Portion 170 may have a total length of approximately 0.110 inches. Lower lip portion 170 engages neck radially extending lower surface 25 at approximately its point of connection with inwardly and downwardly sloping surface 23. At its point of contact 171 with neck surface 25, the inner surface 175 of lip 170 defines a tangent line 173 which is positioned at an angle c with respect to a radial plane 175 which is perpendicular to axis AA. Angle c is preferably less than 25° and is most preferably nearly 0°. Due to the fact that angle c is a relatively small angle, the amount of radially inwardly directed force which is applied to neck 17 by cap 160 as a result of internal pressure in container 13 is reduced substantially over that applied by a prior art cap 35 under identical container pressure conditions. This result is achieved in part simply by reducing the axial length of the annular flange or skirt portion 164 of cap 160 over that of the prior art cap. Such an axial length reduction enables portion 170 to arc inwardly around neck lower surface 25 at a closer angle c than with the prior art design because the lower end of lip portion 170 does not come into interfering contact with neck surface 27 during the crimping process. In the prior art cap configuration 35 shown in FIG. 1, portion 45 does come into interfering contact with neck portion 27.

As with the previously described cap embodiment 60, the alternative cap embodiment 160 also achieves a commercial advantage over the prior art cap configuration 35 due to its reduced size, lower material cost, ease of application, and increased strength.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A closure assembly for a pressurized, plastic beverage container having an upper end opening with a central longitudinal axis comprising:

a) an annular container neck defining said container upper end opening comprising a radially extending top surface, an axially extending surface, and a lower, generally radially extending surface;

b) a gasket positioned on top of said annular container neck; and c) a container cap comprising a flat central body positioned in covering relationship with said container opening and in abutting engagement with said gasket and an annular flange including an axially extending portion positioned in parallel, adjacent, noncompressive relationship with said axially extending surface of said container neck, and a generally radially inwardly extending portion positioned in abutting, compressive contact with said lower, generally radially extending surface of said container neck whereby upwardly directed axial force on said container cap produced by pressurization of said container is resisted by downwardly directed axial force applied by said lower, generally radially extending surface of said container neck to said generally radially inwardly extending portion of said flange of said cap; said lower generally radially extending surface of said container neck intersecting a radial plane extending perpendicularly to said central longitudinal axis of said opening at an angle of between ×20° and −20° whereby there is no significant radial force component to the force exerted by said radially inwardly extending portion of said cap against said generally radially extending surface of said container neck due to pressurization of said container whereby inward flexing of said container neck due to pressurization is obviated.

2. The invention of claim 1, said radially inwardly extending portion of said cap comprising a length less than the length of said lower radially extending surface of said container neck.

3. The invention of claim 2, said lower radially inwardly extending surface of said container neck comprising a length of approximately 0.016 inch.

4. The invention of claim 3, said axially extending surface of said container neck comprising a length of approximately 0.09 inch.

5. The invention of any one of claims 1–4 wherein said beverage container comprises a party ball constructed from PET plastic.

6. A closure assembly for a pressurized beverage dispensing device of the type including a plastic container having an opening at a top portion thereof defined by a container neck, and including a container cap having an annular flange portion engaged with the container neck and a flat, radially extending portion covering the container opening and provided with bores therethrough for sealingly accepting conduit therein for enabling pressurization of the container and discharge of beverage therefrom, and including a gasket mounted between the container cap and an upper surface of the container neck, characterized in that:

said container neck comprises:

a) an inner axially extending surface defining an opening of approximately 1.960 inches in diameter;

b) an upper most radially extending surface integrally connected with said inneraxially extending surface by a first arcuate surface;

c) an upper, outer, axially extending surface integrally connected with said uppermost radially extending surface by a second arcuate surface and radially spaced from said inner axially extending surface by approximately 0.135 inch and having an axial length of approximately 0.093 inch;

d) a radially inwardly and axially downwardly extending surface inclined approximately 80° with respect to said upper, outer, axially extending surface and integrally connected with said upper, outer, axially extending surface by a third arcuate surface and adapted to contact said flange portion for resisting upward axial movement of said container cap during container pressurization without producing a substantial radial force component;

e) an axially downwardly and radially outwardly extending surface integrally connected with said radially inwardly and axially downwardly extending surface by a fourth arcuate surface and inclined approximately 94° relative to said downwardly and inwardly extending surface; and f) a lower axially extending surface integrally connected with said axially downwardly and radially outwardly extending surface and radially inwardly spaced approximately 0.056 inch from said upper, outer, axially extending surface.

7. The invention of claim 6 being further characterized in that:

said container cap has an annular flange comprising:

a) an upper shoulder portion positioned in engaging contact with a gasket;

b) an intermediate axially extending portion positioned in noncompressive relationship with said upper, outer, axially extending surface of said container neck; and c) a lower, generally radially inwardly extending, terminal end portion positioned in compressive, parallel, abutting relationship with said radially inwardly and axially downwardly extending surface of said container neck.

8. A container cap for a pressurized, plastic beverage container having an upper end opening defined by an annular container neck which includes a radially extending top surface, an axially extending surface, and a lower, generally radially extending surface, comprising:

a flat central body positioned in covering relationship with said container opening; and an annular flange including an axially extending portion positioned in parallel, adjacent, noncompressive relationship with said axially extending surface of said container neck, and a generally radially inwardly extending portion positioned in abutting, compressive contact with said lower, generally radially extending surface of said container neck whereby upwardly directed axial force on said container cap produced by pressurization of said container is resisted by downwardly directed axial force applied by said lower, generally radially extending surface of said container neck to said generally radially inwardly extending portion of said flange of said cap without generation of a substantial radial side force which would produce inward flexing of the container neck.

9. The invention of claim 8, said radially inwardly extending portion of said cap comprising a length less than the length of said lower radially extending surface of said container neck.

10. The invention of claim 9, said lower radially inwardly extending surface of said container neck comprising a length of approximately 0.016 inch.

11. The invention of claim 10, said axially extending surface of said container neck comprising a length of approximately 0.09 inch.

12. The invention of any one of claims 8–11 wherein said beverage container comprises a part ball constructed from PET plastic.

13. A container neck for a pressurized beverage dispensing device of the type including a plastic container having an opening at a top portion thereof defined by said container neck, and including a container cap having an annular flange portion engaged with the container neck and a flat, radially extending portion covering the container opening and provided with bores therethrough for sealingly accepting conduit therein for enabling pressurization of the container and discharge of beverage therefrom, and including a gasket mounted between the container cap and an upper surface of the container neck, said container neck comprising:

a) an inner extending surface defining an opening of approximately 1.960 inches in diameter;

b) an uppermost radially extending surface integrally connected with said inner axially extending surface by a first arcuate surface;

c) an upper, outer, axially extending surface integrally connected with said uppermost radially extending surface by a second arcuate surface and radially spaced from said inner axially extending surface by approximately 0.135 inch and having an axial length of approximately 0.093 inch;

d) a radially inwardly and axially downwardly extending surface inclined approximately 80° with respect to said upper, outer, axially extending surface and integrally connected with said upper, outer axially extending surface by a third arcuate surface and adapted to contact said flange portion for resisting upward axial movement of said container cap during container pressurization without producing a substantial radial force component;

e) an axially downwardly and radially outwardly extending surface integrally connected with said radially inwardly and axially downwardly extending surface by a fourth arcuate surface and inclined approximately 94° relative to said downwardly and inwardly extending surface; and f) a lower axially extending surface integrally connected with said axially downwardly and radially outwardly extending surface and radially inwardly spaced approximately 0.056 inch from said upper, outer, axially extending surface.

* * * * *

UNITED STATES PATENT AND TRADEMARK OFFICE

CERTIFICATE OF CORRECTION

PATENT NO. : 5,038,952

DATED : August 13, 1991

INVENTOR(S) : Jan L. Dorfman

It is certified that error appears in the above-identified patent and that said Letters Patent is hereby corrected as shown below:

In the Claims:

Claim 1, Column 8, line 11, "X20°" should read —+20°—.

Signed and Sealed this

Fifteenth Day of December, 1992

*Attest:*

DOUGLAS B. COMER

*Attesting Officer*

*Acting Commissioner of Patents and Trademarks*